US005647639A

United States Patent [19]

Wiggins

[11] Patent Number: 5,647,639

[45] Date of Patent: Jul. 15, 1997

[54] ORTHOPEDIC CHAIR FOR SUPPORTING A PERSON WEARING A CAST

[76] Inventor: Christopher Wiggins, 5207 Clairemont, Midland, Mich. 48624

[21] Appl. No.: 710,837

[22] Filed: Sep. 23, 1996

Related U.S. Application Data

[63] Continuation of Ser. No. 450,932, May 25, 1995, abandoned.

[51] Int. Cl.[6] ..... A47D 13/08

[52] U.S. Cl. ..... 297/467; 297/338; 297/446.1; 297/310; 297/466

[58] Field of Search ..... 297/310, 338, 297/344.12, 344.18, 411.43, 446, 467, 466, 464

[56] References Cited

U.S. PATENT DOCUMENTS

| | | | |
|---|---|---|---|
| 547,198 | 10/1895 | Bimeler | 297/310 |
| 2,515,527 | 7/1950 | Robinson | 297/344.18 X |
| 3,572,030 | 3/1971 | Storer | 297/467 |
| 3,992,057 | 11/1976 | Studebaker | 297/467 |
| 4,125,269 | 11/1978 | Kiel | 297/310 X |
| 4,165,127 | 8/1979 | Vago | 297/344.18 |
| 5,372,405 | 12/1994 | Cash et al. | 297/467 X |

*Primary Examiner*—Peter R. Brown
*Attorney, Agent, or Firm*—Michael D. Wiggins

[57] ABSTRACT

An orthopedic chair for supporting a person wearing a hip spica cast in an upright position includes a seat having a front side and a rear side. A rear support, connected to the seat along said rear side, extends upwardly therefrom. A front support, spaced from the rear support, is connected to the seat along said front side and extends upwardly therefrom. A seat supporting device supports the seat above a surface. The person is supported in an upright position by said seat, and said front and rear supports with one leg extending between one side of said front support and said rear support and another leg extending between an opposite side of said front support and said rear support. Stabilizing legs can be provided to prevent tipping. Adjustment devices allow adjustment of seat height and width between the front and rear supports.

15 Claims, 2 Drawing Sheets

Figure 3
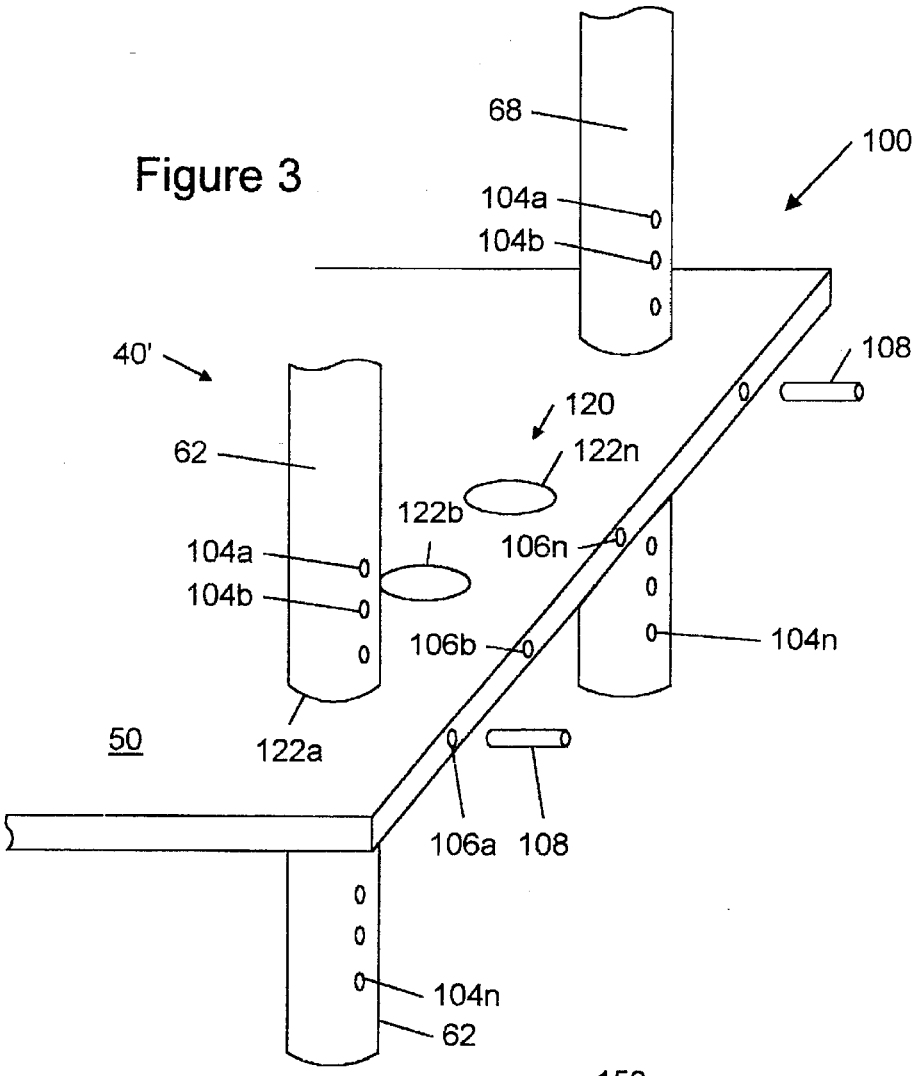
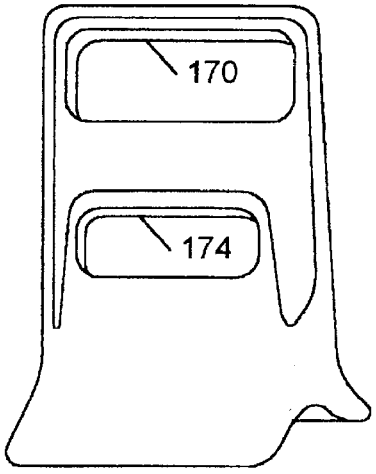
Figure 4A
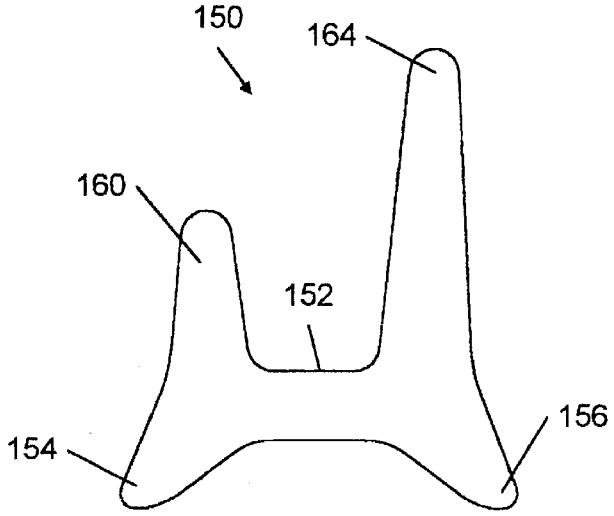
Figure 4B

ORTHOPEDIC CHAIR FOR SUPPORTING A PERSON WEARING A CAST

This is a continuation of U.S. patent application Ser. No. 08/450,932, filed May 25, 1995, now abandoned.

BACKGROUND OF THE INVENTION

1. Technical Field

This invention relates to chairs and, more particularly, to an orthopedic chair for supporting a person wearing a cast.

2. Background of the Invention

There are approximately 250 million residents of the United States and each year there are about 4 million new births. Of the new births, 3–5% (120,000–200,000) of the infants have congenital hip dislocation in which the rounded head of the thigh bone does not sit properly in the hip socket. Treatment of congenital hip dislocation has a high success rate when diagnosed and treated on or about the fifth month after birth. Treatment typically involves abduction and splintage of the unstable hip(s).

After surgery, doctors place the infant in a hip spica cast, a form of splintage which is a full or nearly-full body cast, for approximately three months. The infant in the hip spica cast must lie on his/her back or front and be turned every four hours. Typically the infant's legs are positioned in an outwardly projecting fashion, approximately parallel to a plane defined by the infant's shoulders, such that the infant's torso and legs form a inverted "T"-shape. The hip spica cast positions the infant's legs in this fashion to allow the infant to lie comfortably on either his/her back or front.

Conventional chairs normally used for feeding infants cannot be employed since they fail to accommodate the infant's outwardly projecting legs.

Able to lie only on his/her back or front, the infant is forced to assume a restricted life. In addition, when lying on his/her back or front, the infant can develop bed sores which develop when the infant lies in one position too long. Common places for bed sores include heels, elbows, shoulder blades, and tail bones.

Therefore, it would be desirable to provide a chair which allows the infant wearing a hip spica cast to assume a more normal life and to reduce bed sores caused by lying on the infant's back or front too long.

SUMMARY OF THE INVENTION

An orthopedic chair according to the present invention for supporting a person wearing a hip spica cast in an upright position includes a seat having a front side and a rear side. A rear support, connected to the seat along said rear side, extends upwardly therefrom. A front support, spaced from the rear support, is connected to the seat along said front side and extends upwardly therefrom. A seat supporting device supports the seat above a surface. The person is supported in an upright position by said seat, and said front and rear supports with one leg extending between one side of said front support and said rear support and another leg extending between an opposite side of said front support and said rear support.

According to another feature of the invention, one or more stabilizing legs can be provided to prevent tipping.

According to another feature of the invention, adjustment devices allow adjustment of seat height and width between the front and rear supports.

Other objects, features and advantages will be readily apparent.

BRIEF DESCRIPTION OF THE DRAWINGS

The various advantages of the present invention will become apparent to those skilled in the art after studying the following specification and by reference to the drawings in which:

FIG. 3 is a partial perspective view illustrating height and width adjustment devices which can be incorporated into the orthopedic chair of FIG. 2; and FIGS. 4A and 4B illustrate perspective and side views, respectively of an alternate orthopedic chair according to the present invention.

DESCRIPTION OF THE PREFERRED EMBODIMENT

Figure 1:
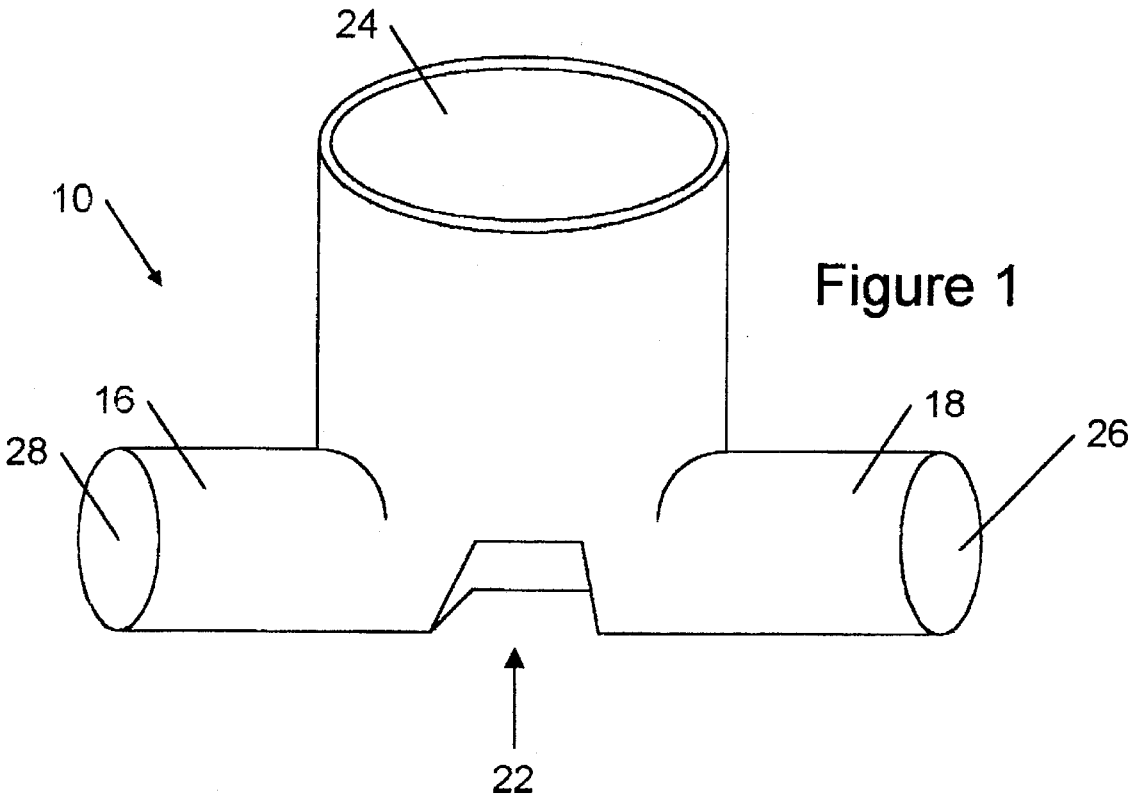
FIG. 1 is a front perspective view of a hip spica cast.

In FIG. 1, a hip spica cast 10 is illustrated and includes a hip portion 12 and first and second leg portions 16 and 18 projecting outwardly therefrom. A lower opening 22 provides clearance to allow the infant to go to the bathroom without soiling hip spica cast 10. An upper opening 24 is formed around the infant's hip, ribs, or underarms depending upon the desired level of splintage.

Leg openings 26 and 28 are formed around the thighs of the infant. Legs 18 and 20 preferably extend approximately to the infant's mid-thigh region. Typically legs 18 and 20 are directed outwardly in a plane parallel to the infant's shoulder plane to allow the infant to be situated comfortably on either the infant's back or front side.

Figure 2:
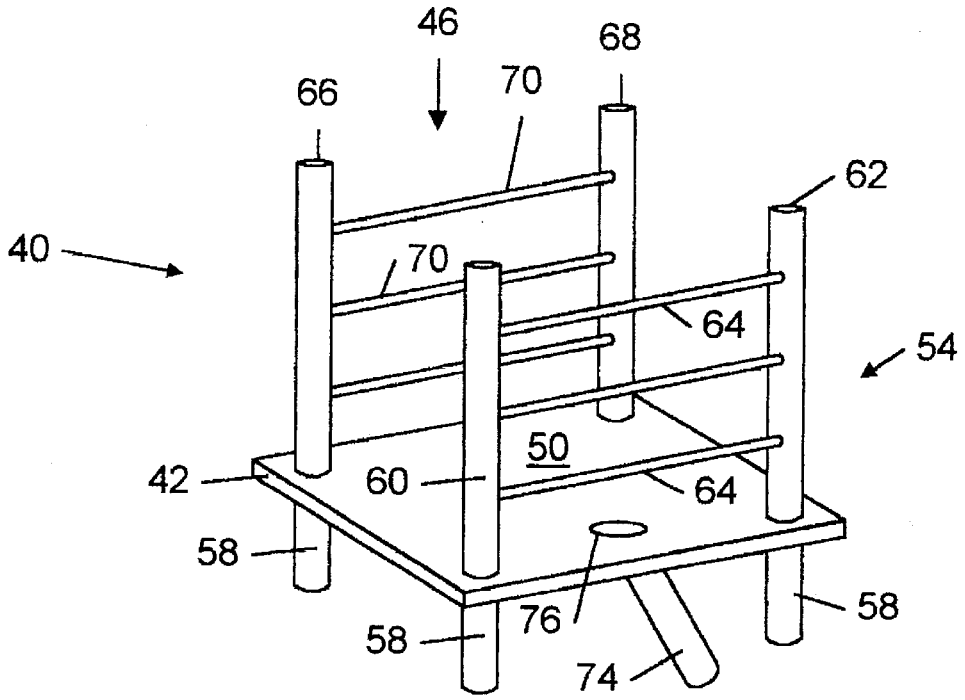
FIG. 2 is an angled front perspective view illustrating an orthopedic chair according to the present invention.

In FIG. 2, an orthopedic chair 40 is illustrated and includes a seat 42 and rear support 46 connected to seat 42 and extending above an upper surface 50 of seat 42. A front support 54 is connected to seat 42, is spaced rear support 46, and extends above upper surface 50 of seat 42. One or more legs 58 support the seat 42 in a stable position above a surface.

In use, an infant wearing hip spica 10 cast can be supported in an upright position to allow the infant to be aware of his/her surroundings and participate more readily. The infant is seated between front support 54 and rear support 46. The infant is seated with one leg lying on seat 42 between one side of front support 54 and one side of rear support 46 and with another leg lying on seat 42 between an opposite side of front support 54 and opposite side of rear support 46. Preferably the space between front support 54 and rear support 46 is sufficient to allow infant to be easily seated and removed but close enough to prevent excessive movement which may cause orthopedic chair 40 to tip.

Preferably, a distance between opposite sides of seat 50 is less than the distance between openings 26 and 28 on legs 18 and 16 of hip spica cast 10 such that seat 50 does not place pressure points on the legs of the infant.

In a preferred embodiment illustrated in FIG. 1, front support 54 includes first and second vertical support members 60 and 62 and a plurality of horizontal support members 64. Likewise, rear support 46 also preferably includes first and second vertical support members 66 and 68 connected by a plurality of horizontal support members 70. One or more stabilizing legs 74 can also be provided to provide additional stability during use. Preferably stabilizing leg 74 extend outwardly beyond legs 58 and form an angle with respect to seat 42. A bore 76 can be formed in seat 42 to accept an upper portion of stabilizing leg 74.

As can be appreciated, vertical support members and legs can be formed integrally or separately.

In FIG. 3, an alternate embodiment is illustrated. For purposes of clarity, reference numbers from FIG. 2 are employed where appropriate and some details from FIG. 2 are omitted.

Orthopedic chair 40' includes a height adjustment device 100 illustrated in FIG. 3. Vertical support members 62, 68, 60 (not shown), and 66 (not shown) include a plurality of first horizontal bores 104*a*, 104*b*, . . . , 104*n*. Second horizontal bores 106*a*, 106*b*, . . . , 106*n* in seat 50 can be adjusted to align with horizontal bores 104*a*, 104*b*, . . . , 104*n* in the vertical member. A pin 108 is inserted through horizontal bore 106 into an aligned horizontal bore 104 to adjust the height of seat 50 relative to the supporting surface. Vertical members 60 and 66 (not shown in FIG. 2) include a mirror image of height adjustment device 100.

Orthopedic chair 40' can also include a width adjustment device 120. Preferably width adjustment device 120 includes a plurality of vertical bores 122*a*, 122*b*, . . . , 122*n* in seat 50 which receive vertical member 62 (or vertical member 68). Vertical member 62 is easily removed from horizontal bore 122 by removing pin 108. As can be appreciated, the width between front and rear supports 54, 46 can be adjusted to accommodate infants of varying sizes.

In FIGS. 4A and 4B, an integral orthopedic chair 150 is illustrated and includes a seat 152 supported above a supporting surface by front and rear legs 154 and 156. A front support 160 and a rear support 164 are connected to seat 152. An infant wearing the hip spica cast 10 can be positioned on integral orthopedic chair 150 in a manner similar to that described above in conjunction with orthopedic chair 40. Integral orthopedic chair 150 can further include an opening 170 in rear support 164 and an opening 174 in front support 160. Openings 170 and 174 provide handles for moving integral orthopedic chair 150.

Preferably integral orthopedic chair 150 is formed from plastic and can be sized to accommodate infants of varying sizes.

As can be appreciated, orthopedic chairs 40, 40', and 150 allow an infant wearing hip spica cast 10 to assume a more normal life and to reduce bed sores associated with lying on the infant's back or front for extended periods. The present invention further provides height and width adjustments to accommodate infants of varying sizes.

While it will be apparent that the preferred embodiments of the invention disclosed are well calculated to provide the advantages and features above stated, it will be appreciated that the invention is susceptible to modification, variation, and change without departing from the proper scope of fair meaning of the claims which follow.

What is claimed is:

1. An orthopedic chair in combination with a hip spica cast having a lower body supporting portion with a pair of legs extending outwardly therefrom, said chair for supporting a person in an upright position, comprising:

a seat having a front side, a rear side and opposite lateral sides;

a rear support connected to and extending substantially the length of said rear side of said seat and extending upwardly therefrom;

a front support, spaced from said rear support, connected to and extending substantially the length of said front side of said seat and extending upwardly therefrom, wherein a first distance between said front and rear supports is less than a second distance between said opposite lateral sides of said seat;

seat supporting means, coupled to said seat, for supporting said seat above a surface, wherein said chair is adapted to support the person in an upright position with one of said legs of said hip spica cast extending between one side of said front support and said rear support and another of said legs of said hip spica cast extending between an opposite side of said front support and said rear support.

2. The orthopedic chair of claim 1 wherein said front support includes first and second vertical members connected by a plurality of first horizontal members.

3. The orthopedic chair of claim 2 wherein said rear support includes third and fourth vertical members connected by a plurality of second horizontal members.

4. The orthopedic chair of claim 3 further comprising:

height adjustment means, associated with at least one of said seat and said seat supporting means, for changing the height of said seat relative to said surface.

5. The orthopedic chair of claim 4 wherein said height adjustment means includes:

a plurality of first horizontal bores in said first vertical member;

a plurality of second horizontal bores in said second vertical member;

a plurality of third horizontal bores in said third vertical member;

a plurality of fourth horizontal bores in said fourth vertical member;

a first vertical bore in said seat for slidably receiving said first vertical member;

a second vertical bore in said seat for slidably receiving said second vertical member;

a third vertical bore in said seat for slidably receiving said third vertical member;

a fourth vertical bore in said seat for slidably receiving said fourth vertical member;

fifth, sixth, seventh, and eighth horizontal bores in said seat;

a first mating pin insertable in said fifth horizontal bore, and into one of said plurality of first horizontal bores;

a second mating pin insertable in said sixth horizontal bore and into one of said plurality of second horizontal bores;

a third mating pin insertable in said seventh horizontal bore, and into one of said plurality of third horizontal bores; and a fourth mating pin insertable in said eighth horizontal bore and into one of said plurality of fourth horizontal bores.

6. The orthopedic chair of claim 1 further comprising:

width adjustment means, associated with said seat and at least one of said front and rear supports, for increasing the distance between said front and rear supports.

7. The orthopedic chair of claim 6 wherein said width adjustment means includes:

first and second plurality of vertical bores located on opposite lateral sides of said seat for receiving first and second vertical members of at least one of said front and rear supports.

8. The orthopedic chair of claim 1 wherein the distance between said opposite lateral sides is less than the distance between leg openings of the hip spica cast.

9. An orthopedic chair for supporting a person wearing a hip spica cast in an upright position, comprising:

a seat having a front side and a rear side;

a rear support connected to and extending substantially the length of said rear side of said seat and extending upwardly therefrom;

a front support, spaced from said rear support, connected to and extending substantially the length of said front side of said seat and extending upwardly therefrom;

seat supporting means, coupled to said seat, for supporting said seat above a surface;

wherein said orthopedic chair is adapted to support the person wearing the hip spica cast in an upright position and wherein one leg of the hip spica cast may be extended between one side of said front support and said rear support and another leg of the hip spica cast may be extended between an opposite side of said front support and said rear support; and a stabilizing means, associated with said seat supporting means, for preventing said orthopedic chair from tipping wherein said stabilizing means includes a leg fixedly connected to a bottom of said seat at an angle and for projecting from said seat to said surface and wherein an end of said fixed leg is for contacting said surface outside of said seat supporting means.

10. An orthopedic chair for supporting a person wearing a hip spica cast in an upright position comprising:

a seat having a front side, a rear side and opposite lateral sides;

a rear support connected to and extending substantially the length of said rear side of said seat and extending upwardly therefrom;

a front support, spaced from the rear support, connected to and extending substantially the length of said front side of said seat and extending upwardly therefrom wherein a first distance between said front and rear supports is less than a second distance between said opposite lateral sides of said seat;

seat supporting means for supporting the seat above a surface, wherein said orthopedic chair is adapted to support the person in an upright position and wherein such that one leg of the hip spica cast may be extended between one side of said front support and said rear support and another leg of the hip spica cast may be extended between an opposite side of said front support and said rear support; and width adjustment means, associated with said seat and at least one of said front and rear supports, for increasing the distance between said front and rear supports.

11. The orthopedic chair of claim 10 wherein said width adjustment means includes:

a plurality of vertical bores in said seat for receiving first and second vertical members of at least one of said front and rear supports.

12. The orthopedic chair of claim 10 further comprising:

height adjustment means, associated with at least one of said seat and said seat supporting means, for changing the height of said seat relative to said surface.

13. The orthopedic chair of claim 10 further comprising:

a stabilizing means, associated with said seat supporting means, for preventing said orthopedic chair from tipping.

14. The orthopedic chair of claim 13 wherein said stabilizing means includes a fixed leg connected to a bottom surface of said seat at an angle and projecting from said seat to said surface and wherein an end of said fixed leg contacts said surface outside of said seat supporting means.

15. The orthopedic chair of claim 10 wherein said orthopedic chair is formed of plastic.

* * * * *